US008128313B2

(12) United States Patent
Rouse et al.

(10) Patent No.: US 8,128,313 B2
(45) Date of Patent: Mar. 6, 2012

(54) ZERO VELOCITY BEAD DISPENSER

(75) Inventors: Patrick T. Rouse, Ames, IA (US); Marvin Lee Van Bruggen, Orange City, IA (US); Matthew Joseph Brossard, Orange City, IA (US)

(73) Assignee: EZ Liner, Orange City, IA (US)

( * ) Notice: Subject to any disclaimer, the term of this patent is extended or adjusted under 35 U.S.C. 154(b) by 431 days.

(21) Appl. No.: 12/370,947

(22) Filed: Feb. 13, 2009

(65) Prior Publication Data

US 2009/0208287 A1 Aug. 20, 2009

Related U.S. Application Data

(60) Provisional application No. 61/028,653, filed on Feb. 14, 2008.

(51) Int. Cl.
*E01C 23/16* (2006.01)
*E01F 9/06* (2006.01)

(52) U.S. Cl. ..... 404/94; 404/14

(58) Field of Classification Search ..... 404/93, 404/94, 14; 124/78; 198/624; 414/797.4, 414/797.7

See application file for complete search history.

(56) References Cited

U.S. PATENT DOCUMENTS

| | | | | | |
|---|---|---|---|---|---|
| 2,316,798 | A | * | 4/1943 | Luebbe | 242/564.4 |
| 3,355,112 | A | | 11/1967 | Shaffer et al. | |
| 3,386,629 | A | | 6/1968 | Currie | |
| 3,472,200 | A | | 10/1969 | Gerling | |
| 3,608,972 | A | * | 9/1971 | Rudszinat | 406/70 |
| 4,072,611 | A | * | 2/1978 | Davis | 210/143 |
| 4,319,717 | A | | 3/1982 | Hofmann | |
| 4,369,001 | A | * | 1/1983 | Eigenmann | 404/94 |
| 4,423,717 | A | * | 1/1984 | Kahelin | 124/78 |
| 4,518,121 | A | | 5/1985 | Smith | |
| 4,655,190 | A | * | 4/1987 | Harris | 124/78 |
| 4,792,259 | A | * | 12/1988 | Eigenmann | 404/73 |
| 4,873,925 | A | * | 10/1989 | Hultberg et al. | 101/147 |
| 5,203,923 | A | | 4/1993 | Hartman | |
| 5,275,504 | A | * | 1/1994 | Nonemaker | 404/72 |
| 5,294,798 | A | | 3/1994 | Hartman | |
| 5,794,606 | A | * | 8/1998 | Deak | 124/51.1 |
| 6,027,281 | A | * | 2/2000 | Neuling | 404/75 |
| 6,401,704 | B1 | * | 6/2002 | Caldwell | 124/78 |
| 6,511,259 | B1 | | 1/2003 | Khieu et al. | |
| 6,796,740 | B2 | * | 9/2004 | Chiron et al. | 404/94 |
| 6,913,417 | B2 | * | 7/2005 | Lind et al. | 404/93 |
| 7,429,146 | B2 | * | 9/2008 | Hall et al. | 404/93 |
| 2008/0310917 | A1 | | 12/2008 | Hall et al. | |

* cited by examiner

*Primary Examiner* — Thomas Will
*Assistant Examiner* — Abigail A Risic
(74) *Attorney, Agent, or Firm* — McKee, Voorhees & Sease, P.L.C.

(57) ABSTRACT

A zero velocity bead dispenser is provided for a paint striping vehicle. The dispenser includes an electric motor which rotates a pair of rollers. A bead gun directs reflective particles into the nip point between the rollers, which discharge the particles or beads with a rearward velocity substantially matching the forward velocity of the vehicle. Therefore, the beads are discharged into the wet paint on the road with a net zero velocity so as to minimize or eliminate rolling of the beads in the paint, thereby maximizing the reflective properties of the beads. A speed sensor continuously monitors the vehicle speed and automatically adjusts the motor speed, and thus the roller speed, so as to maintain the relative zero velocity of the discharged beads.

20 Claims, 7 Drawing Sheets

ZERO VELOCITY BEAD DISPENSER

CROSS-REFERENCE TO RELATED APPLICATIONS

This application claims priority under 35 U.S.C.§119 of a provisional application Ser. No. 61/028,653 filed Feb. 14, 2008, which application is hereby incorporated by reference in its entirety.

BACKGROUND OF THE INVENTION

Roadways typically have markings painted thereon to delineate lanes for traffic movement, as well as safety zones for passing vehicles. The white or yellow paint is usually applied by a moving truck or similar mobile device using a pressurized system to spray solid or broken lines ranging from 4-8 inches wide onto the road surface. This prior art road striping equipment also normally includes a bead applicator positioned immediately behind the paint spray nozzle or gun which applies a stream of small diameter glass beads or reflective particles onto the paint. The beads stick to the wet paint, and reflect light from vehicle headlights back toward the vehicle during nighttime driving so as to enhance visibility of the painted line. In the traditional paint and bead application process, the paint striper truck moves at 8-12 miles per hour. This forward velocity of the truck produces a forward velocity for the dispensed beads, which tend to roll in the paint, thereby causing the bead to be partially or completely covered with paint, thereby reducing or eliminating the light which is reflected by the beads.

U.S. Pat. No. 6,511,259 attempts to solve the bead rolling problem by discharging the beads in a rearward direction using a fluid assisted dispenser so that the reflective particles are ejected at substantially the same velocity that the striper truck or vehicle is moving forwardly, but in the opposite direction, so that the relative velocity of the beads as they hit the pavement is close to zero. However, the device of the U.S. Pat. No. 6,511,259 patent does not have the ability to adjust the particle dispenser as the speed of the striper vehicle varies. Therefore, the zero relative velocity of the beads can be achieved at only one vehicle speed.

Accordingly, a primary objective of the present invention is the provision of an improved road striping vehicle which dispenses reflective beads into wet road stripe paint at a relative zero velocity, regardless of the vehicle speed.

Another objective of the present invention is the provision of an improved road striping vehicle which applies paint and reflective particles to the road at varying speeds.

Another objective of the present invention is the provision of a road striping vehicle which utilizes a pair of opposing rollers to dispense glass beads into freshly sprayed paint on the road.

A further objective of the present invention is the provision of a road striping vehicle having rollers for dispensing reflective beads into road stripe paint, wherein the speed of the rollers can be adjusted so as to correspond to the speed of the vehicle.

Still another objective of the present invention is an improved method for applying reflective beads to a painted road stripe so as to eliminate or minimize rolling of the beads in the paint.

Yet another objective of the present invention is the method of applying a reflective line onto a road wherein a paint stripe is applied and then reflective beads are dispensed into the wet paint with substantially zero horizontal velocity.

A further objective of the present invention is the provision of an improved road striping vehicle which is economical to manufacture, and which is efficient, effective, accurate and durable in use.

These and other objectives will become apparent from the following description of the invention.

SUMMARY OF THE INVENTION

The present invention offsets the forward movement of the paint striping truck by expelling the beads or reflective particles rearwardly and downwardly at substantially the same speed as the vehicle, thereby allowing the bead to have a net velocity of approximately zero. Accordingly, the beads fall onto the paint without rolling forward, thereby maximizing the reflective function of the particles or beads.

In a preferred embodiment, the reflective particles are dispensed onto the paint by a pair of parallel rubber coated rollers. One of the rollers is driven by an electrical motor which receives a variable voltage signal from an electrical control device which constantly measures the ground speed of the truck and adjusts the speed of the drive roller to substantially match the speed of the vehicle. A second roller is driven by the first roller through intermeshing gears or by direct engagement between the roller surfaces. The glass beads or reflective particles are stored in a pressurized vessel on the truck and conveyed under pressure to one or more bead guns via a flexible hose. A metering nozzle dispenses the beads into the intake side of the rotating rollers, with the beads passing through the nip point for downward and rearward discharge onto the wet paint at a controlled velocity preferably equal to the opposite forward velocity of the paint truck. Thus, the particles are dispensed with a net zero velocity relative to the road surface.

BRIEF DESCRIPTION OF THE DRAWINGS AND PHOTOGRAPHS

FIG. 1 is a schematic view of a road striper truck having the bead dispenser of the present invention.

FIG. 1*a* is an enlarged view taken along the circle 1A of FIG. 1.

DETAILED DESCRIPTION OF THE DRAWINGS

Figure 1:
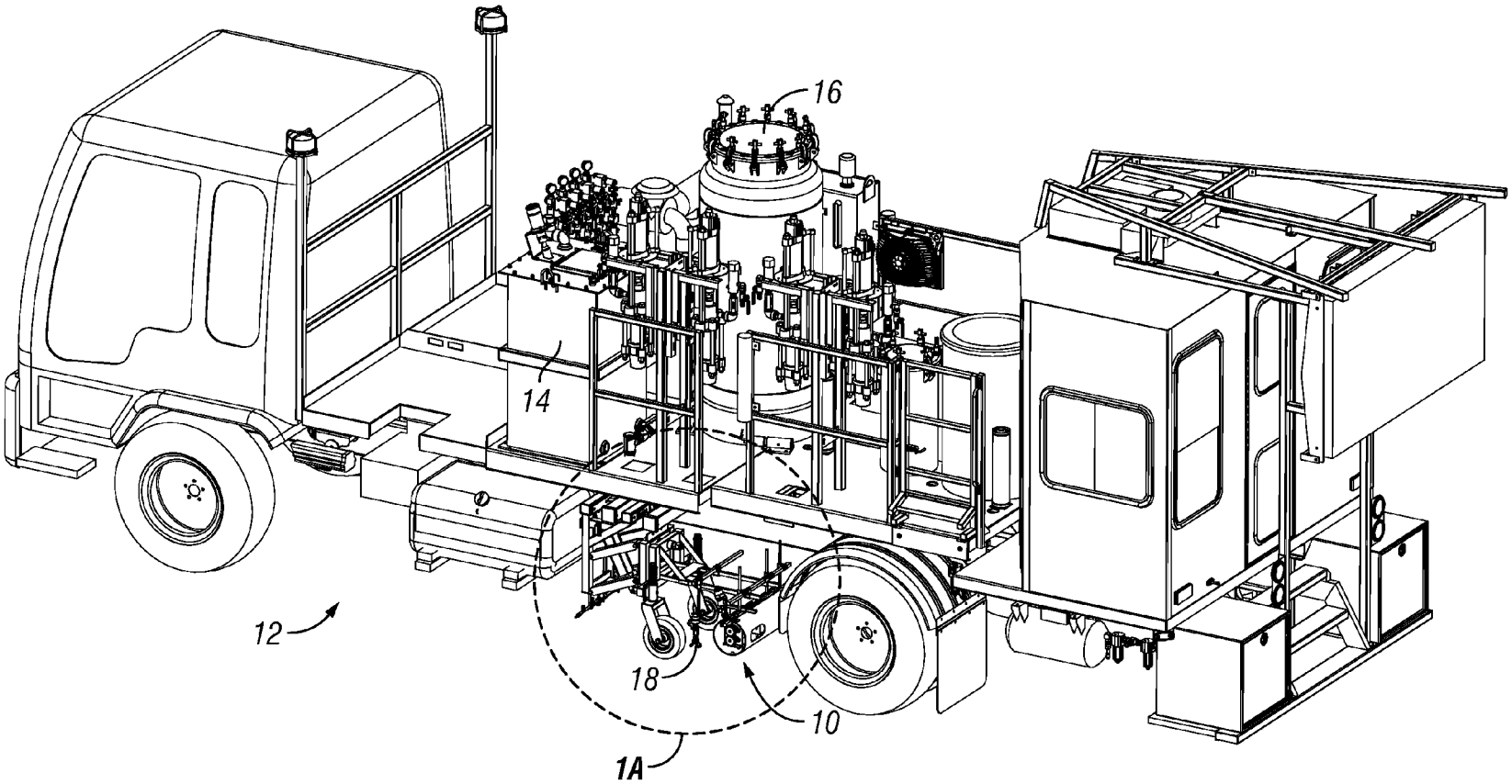
Figure 1A:
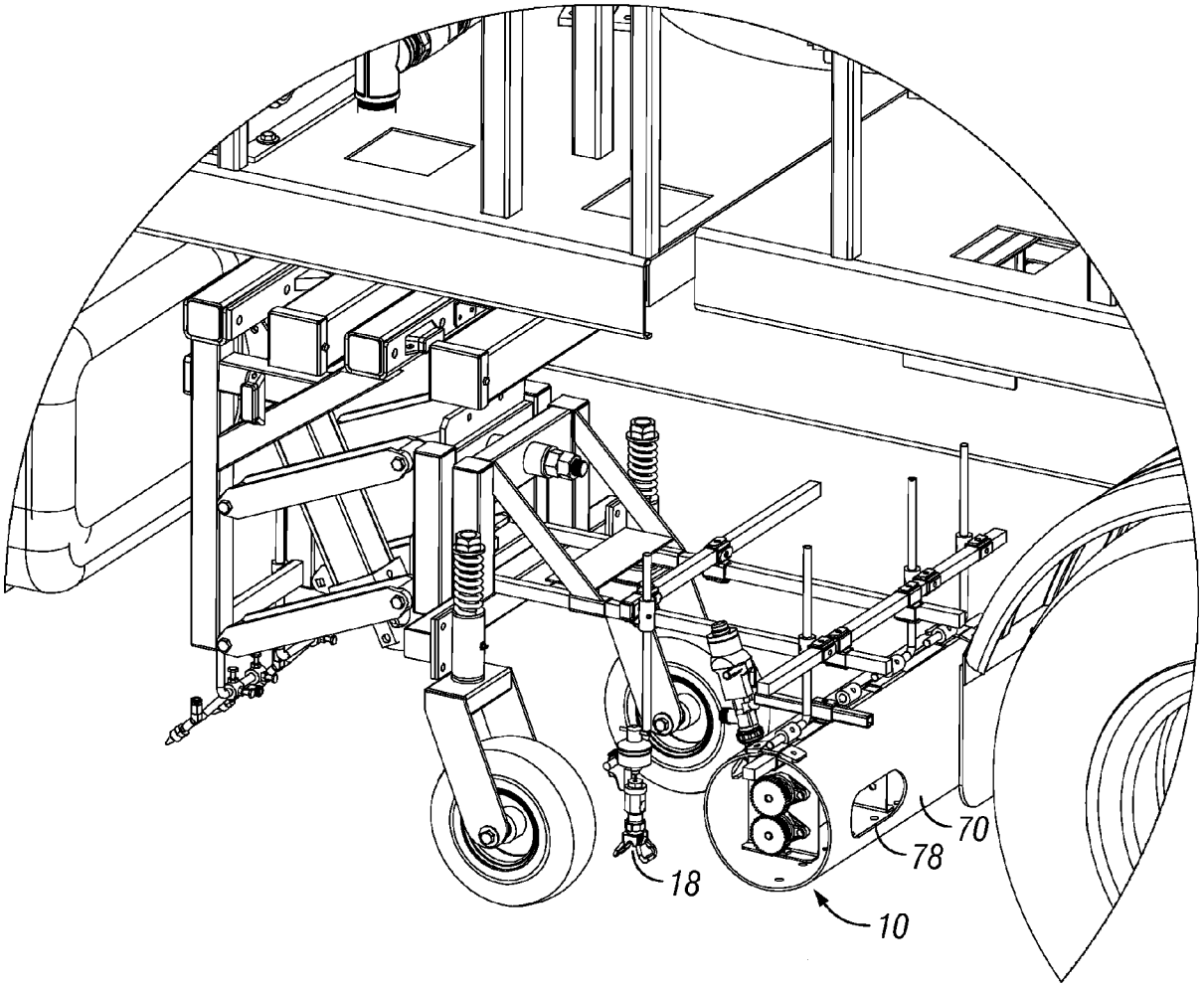

The zero velocity bead dispenser assembly of the present invention is generally designated in the drawings by the reference numeral 10. The assembly 10 is mounted on a road striper vehicle or truck 12, which includes a paint storage tank or vessel 14, and a pressurized tank or vessel 16 for storing reflective particles, such as glass beads. The vehicle 12 also includes one or more paint nozzles 18 for spraying paint onto the road surface, so as to form lines, such as those commonly used to mark the driving lanes on the road, passing and no passing zones, the road shoulders, or other markings.

The bead dispenser assembly 10 includes a bead gun 20, a pair of rollers 22, 24, and a chute 26 extending between the bead gun 20 and the rollers 22, 24. The bead gun 20 is operatively connected to the bead vessel 14 via a hose (not shown). The rollers 22, 24 are rotatably supported between a pair of mounting plates 28 at the opposite ends of the rollers 22, 24.

Preferably, roller 22 is mounted above roller 24, with the rollers 22, 24 being closely spaced so as to define a nip point 30 between the rollers. The chute 26 directs the beads from the bead gun 20 into the nip point 30.

The rollers 22, 24 are rotatably supported by bearings 32. The bead dispenser assembly 10 also includes an electric motor 34 mounted between a pair of brackets 36. The motor includes a drive shaft 37 which is coupled to the roller 22 so as to drive the roller when the motor 34 is operating. The roller 22, in turn, rotates the roller 24 via intermeshing timing gears 38, 40 on the ends of the rollers 22, 24, respectively. As an alternative to the meshing gears 38, 40, the rollers 22, 24 may engage one another, such that the drive roller 22 rotates the idler roller 24.

The orientation of the rollers 22, 24 can be adjusted via an adjustable canting mechanism 42. The canting mechanism 42 allows the angle at which the beads are discharged from the rollers 22, 24 to be varied. Preferably, the lower roller 24 is positioned slightly forwardly of the upper roller 22, such that the beads are discharged in a downward and rearward direction.

The speed of the motor 34 is controlled by an electrical control device 46 which continuously senses or monitors the velocity of the truck 12, and sends a variable voltage signal to the motor 34, so as to automatically adjust the speed of the motor, and thus the rotational speed of the rollers 22, 24, so as to substantially match the velocity of the truck 12. One example of a commercially available control device 46 is sold by Minarik Drives, Model No. DC60-12-24. Preferably, the motor 34 is a 12-24 volt motor.

The bead dispenser assembly 10 can be mounted to the truck 12 in any convenient manner. As seen in the drawings, a frame is provided for supporting the assembly 10 behind the paint nozzle(s) 18 of the truck 12. The frame includes a lower mounting bar 54 which extends longitudinally within the shield 50 to support the mounting plates 28 of the rollers 22, 24 and the brackets 36 for the motor 34. The lower mounting bar 54 is secured to an upper mounting bar 56 by rods 58 and brackets 60. Similarly, the bead gun 20 is connected to the lower mounting bar 54 by an adjustable bar 62 extending through a bracket 64 on the lower bar 54.

Figure 2:
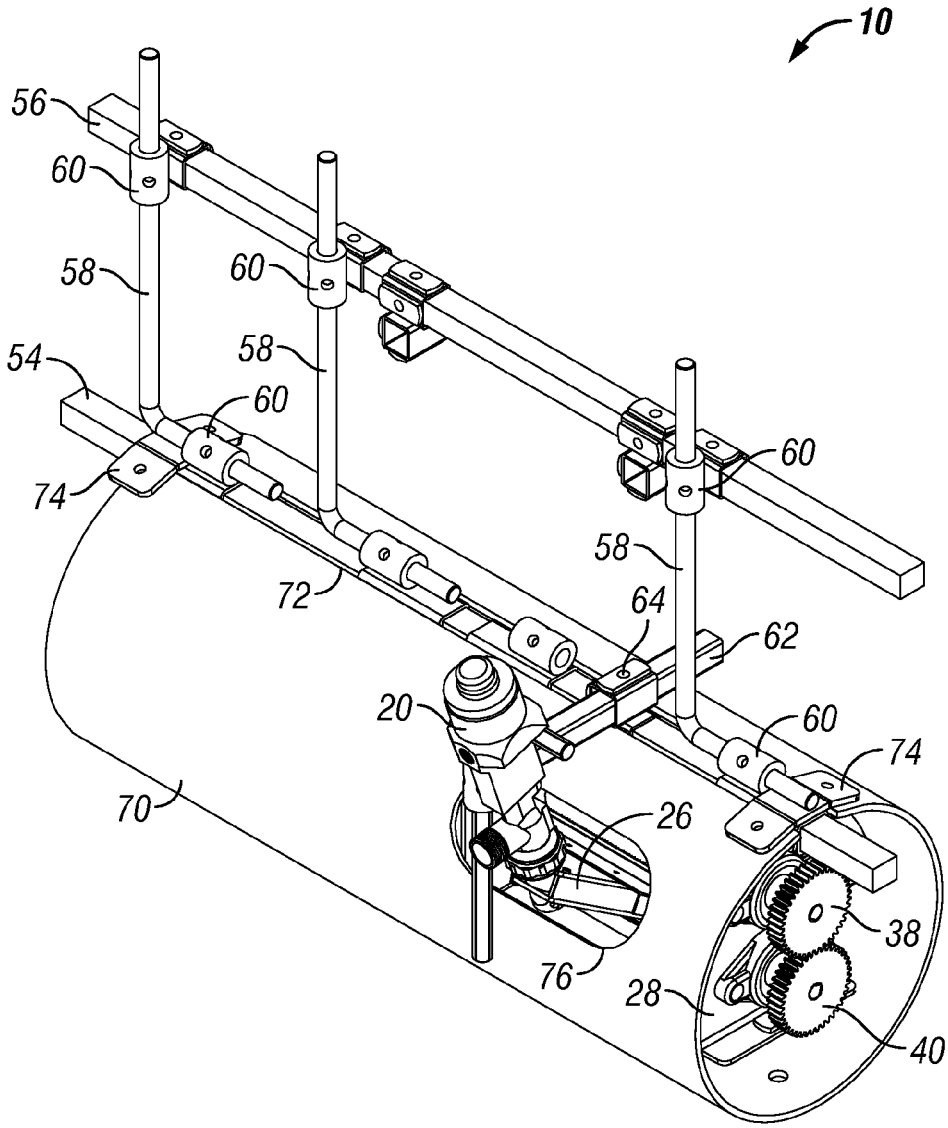
FIG. 2 is a front perspective view of the dispenser with a protective sleeve to protect against paint overspray.
Figure 3:
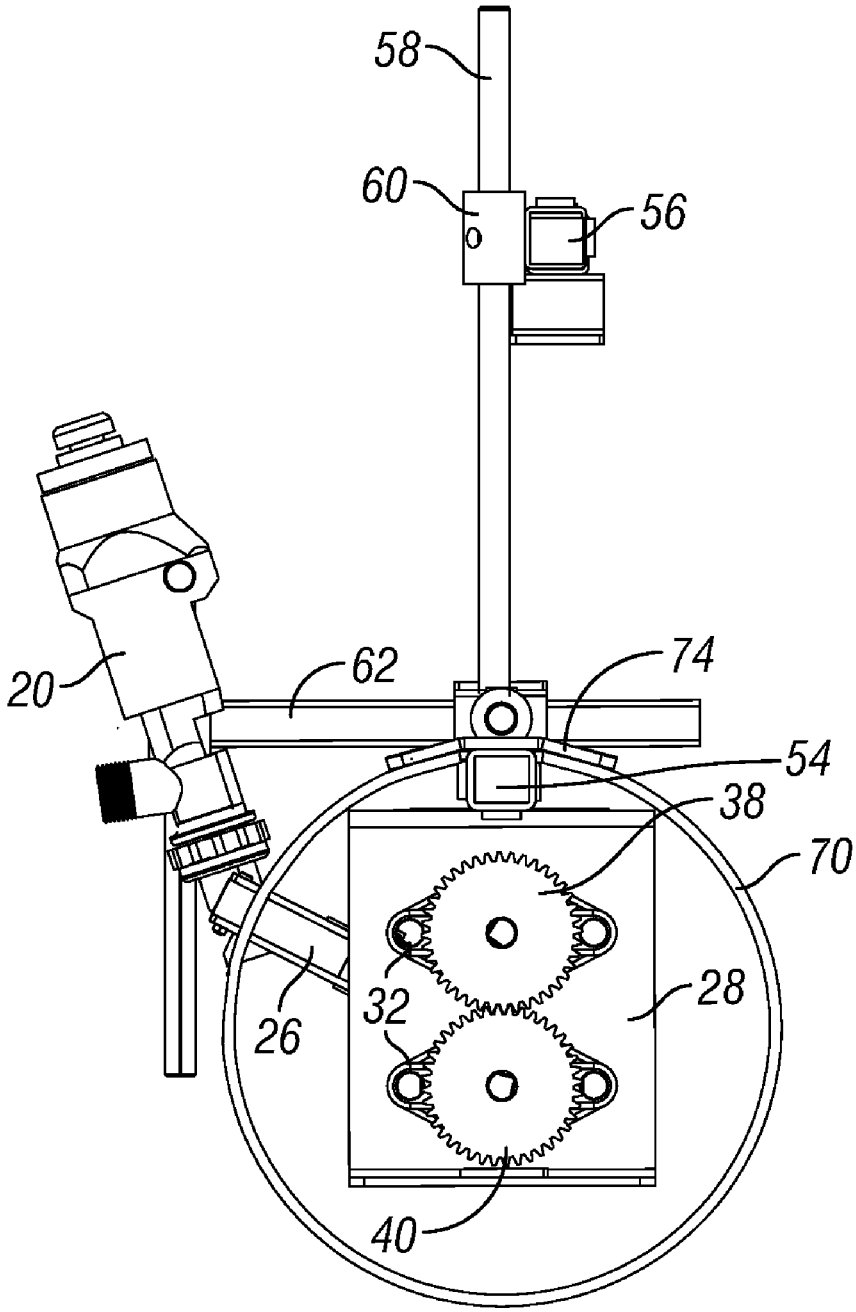
FIG. 3 is an end view of the dispenser with the sleeve.
Figure 4:
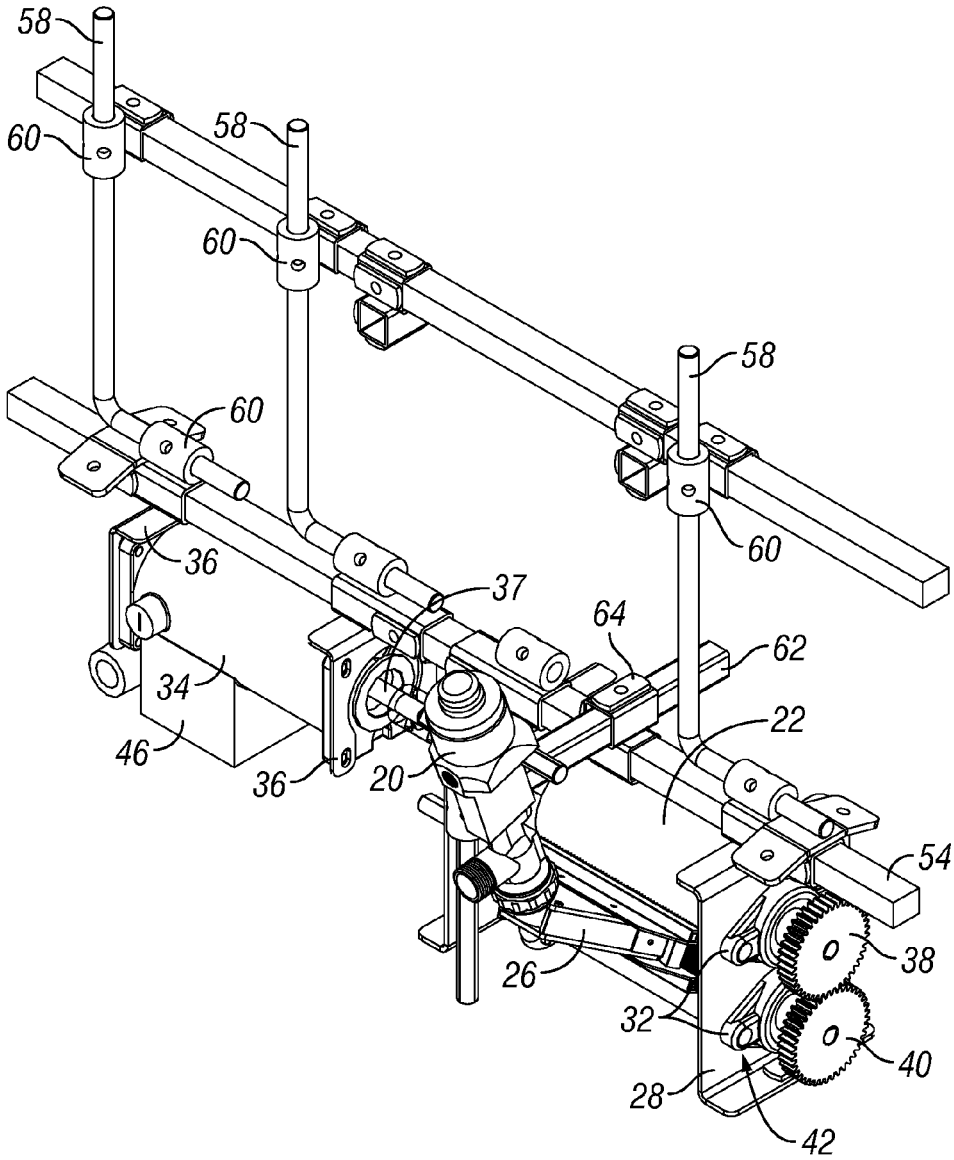
FIG. 4 is a perspective view of the zero velocity bead dispenser of the present invention, from the intake or front side, with the sleeve removed for clarity.
Figure 5:
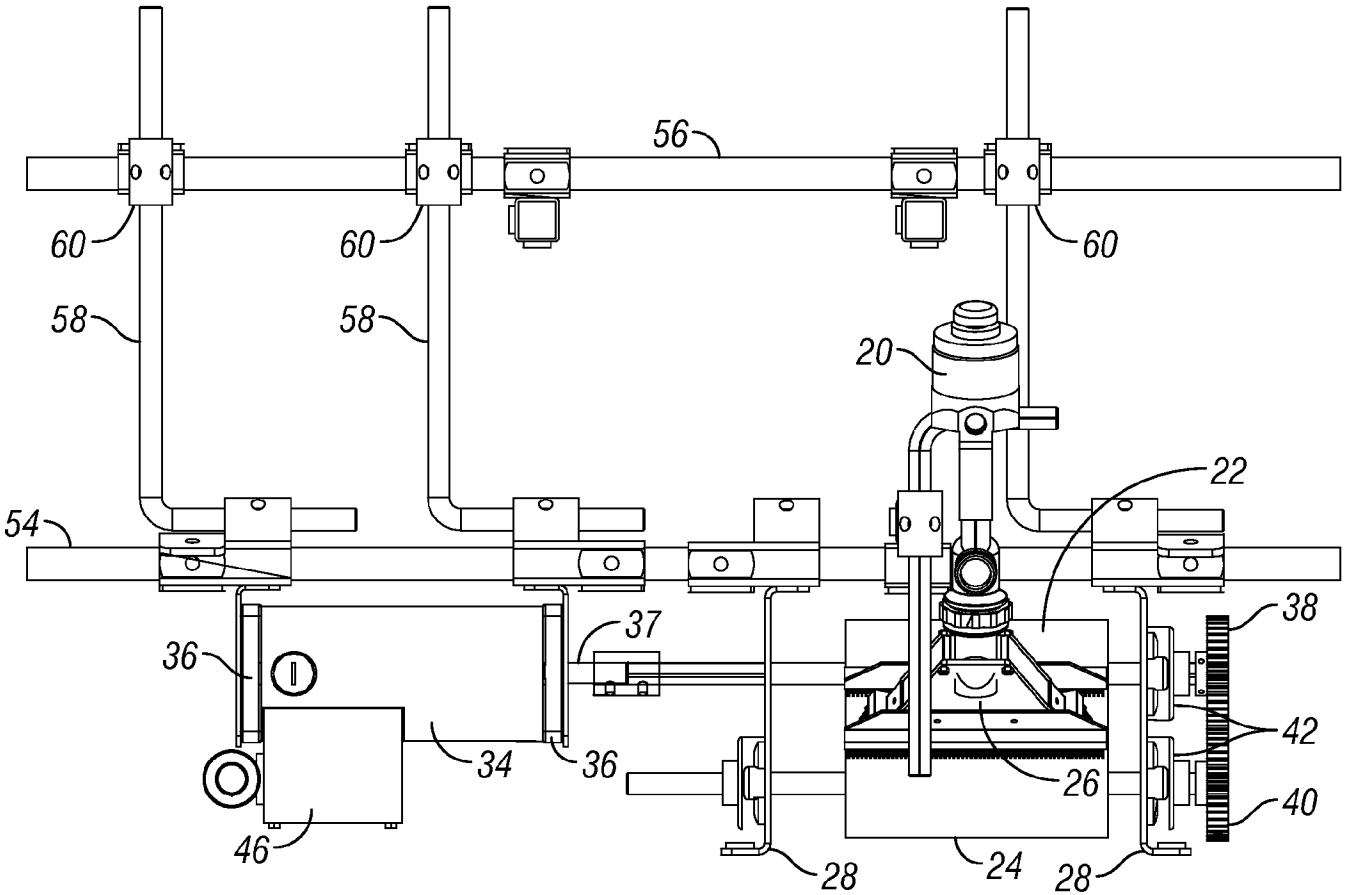
FIG. 5 is a front elevation view of the dispenser.
Figure 6:
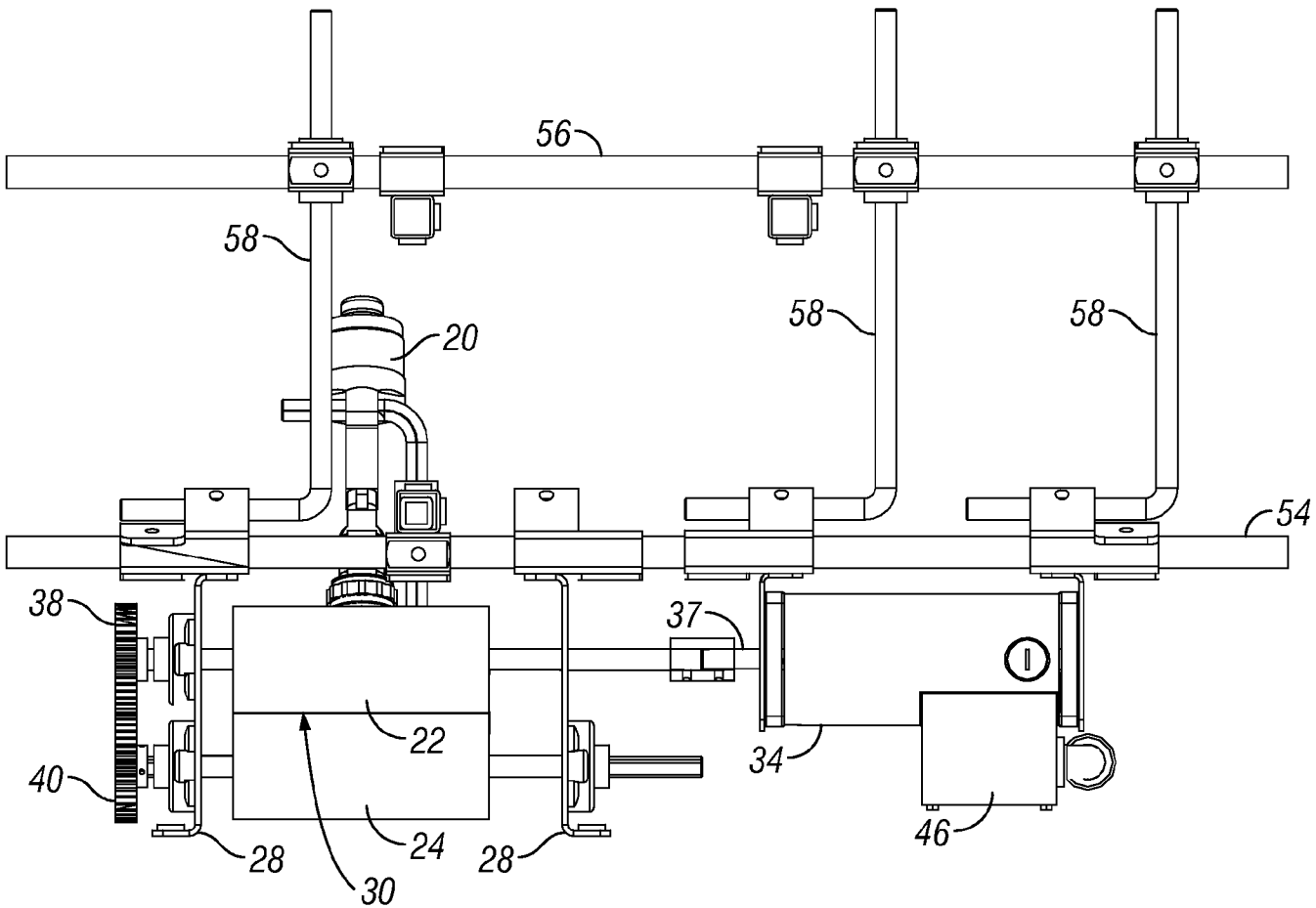
FIG. 6 is a rear elevation view of the dispenser.

A protective shield or guard 70 is provided on the assembly 10 so as to house the rollers 22, 24 and the motor 34, as seen in FIGS. 2 and 3. The shield 70 includes an elongated slot 72 in the upper portion of the shield so as to receive the lower mounting bracket 54 within the shield 70. The bar 54 includes brackets with flanges 74 for mounting the shield 70 to the bar 54. The shield 70 includes a front side opening 76 through which the bead chute 26 extends and an opening 78 on the rear side through which beads are discharged from the rollers 22, 24 onto the wet paint on the road. Drainage holes may be provided in the bottom of the shield 70 so as to drain moisture which collects in the shield 70.

It is understood that the various mounting hardware, such as the bars, rods and brackets, may take configurations and orientations different from that shown in the drawings, without departing from the scope of the present invention.

In use, the paint striping vehicle 12 lays a paint stripe onto the road via the paint nozzle 18. The bead dispenser assembly is located behind the paint nozzle 18 so as to discharge reflective particles, such as glass beads, into the wet paint so as to be partially imbedded in the paint. The rollers 22, 24 discharge the beads from the nip point 30 at a rearward velocity substantially matching the forward velocity of the vehicle 12, such that the beads are laid into the paint with a net zero velocity, thereby precluding or minimizing rolling of the beads in the paint. Thus, the beads maintain maximum reflectiveness. If the speed of the vehicle 12 changes while the paint and reflective beads are being applied to the road surface, the speed controller 46 will automatically adjust the speed of the motor 34, and thereby the rotational speed of the rollers 22, 24, so as to maintain the zero velocity dispensement of the beads relative to the road surface.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A device for dispensing reflective particles at zero velocity from a forwardly moving vehicle painting a line on a road surface, comprising:

a frame mounted to the vehicle;

a motor mounted on the frame and having a drive shaft;

a first roller rotatably mounted on the frame;

a second roller rotatably mounted on the frame in closely spaced relation to the first roller; and the drive motor driving both of the first and second rollers so that the rollers rotate at the same speed throughout operation of the motor;

a nip point between the rollers;

a particle gun on the vehicle to direct a plurality of the reflective particles simultaneously and continuously into the nip point of the rollers for discharge in a rearward and downward direction at a velocity substantially equal to the forward velocity of the vehicle so that a plurality of the particles are dispensed continuously onto the painted line at substantially zero velocity.

2. The device of claim 1 further comprising a chute between the gun and the rollers to direct the particles into the nip point.

3. The device of claim 1 further comprising a controller to monitor the velocity of the vehicle and automatically adjust the speed of the motor to match the velocity of the truck.

4. The device of claim 1 further comprising a speed sensor to sense the forward speed of the vehicle and send a voltage signal to the motor to adjust the speed of the drive shaft, and thus the speed of the rollers.

5. The device of claim 1 wherein the rollers have axes which are horizontally offset with respect to one another.

6. The device of claim 1 wherein the rollers each have axes, and the second roller axis is positioned forwardly from the first roller axis.

7. The device of claim 1 wherein the rollers discharge the particles downwardly without further structural support.

8. An improved road paint striper vehicle, comprising:

a nozzle to paint a line on a road while the vehicle moves with a forward velocity;

a vessel containing reflective particles;

first and second closely spaced pair of driven rollers adapted to receive a plurality of particles simultaneously from the vessel and discharge the particles downwardly with a rearward velocity continuously onto the painted line without structural guidance downstream from the rollers;

a motor drivingly connected to the first and second rollers to rotate the rollers; and the forward and rearward velocities being substantially equal.

9. The vehicle of claim 8 wherein the motor is an electric motor operatively connected to the rollers to rotate the rollers at the same speed.

10. The vehicle of claim 9 further comprising a speed sensor to sense the speed of the vehicle and being operatively connected to the motor to vary the motor speed to correspond to the vehicle speed.

11. The vehicle of claim 8 further comprising a chute to direct particles from the vessel to a nip point between the rollers.

12. The vehicle of claim 8 wherein the second roller is positioned forwardly of the first roller.

13. The vehicle of claim 8 wherein the first roller is above the second roller to define a substantially horizontal nip point between the rollers.

14. The vehicle of claim 8 wherein the rollers discharge the particles in a downward direction.

15. A method of applying a reflective line onto a road, comprising:

driving a paint striper truck forwardly while spraying a line of paint onto the road;

rotating a pair of rollers at the same speed;

directing a plurality of reflective particles simultaneously through the pair of rotating rollers to continuously discharge a plurality of the particles simultaneously in a rearward and downward direction onto the line of paint; and substantially matching the forward velocity of the truck with the rearward velocity of the particles so that the particles hit the paint with substantially zero horizontal velocity.

16. The method of claim 15 further comprising sensing the speed of the truck and adjusting the rotational speed of the rollers to maintain zero horizontal velocity for the particles.

17. The method of claim 15 further comprising adjusting the rotational speed of the rollers to correspond to the speed of the truck.

18. The method of claim 15 wherein the particles are discharged into the paint without rolling.

19. The method of claim 15 wherein the particles enter a nip point between the rollers via a chute and exit the nip point without a chute.

20. The method of claim 15 wherein the rollers have horizontally offset axes to impart the downward direction to the particles.

* * * * *